US010099891B2

(12) United States Patent
Mizuguchi

(10) Patent No.: US 10,099,891 B2
(45) Date of Patent: Oct. 16, 2018

(54) SHEET STACKING APPARATUS AND IMAGE FORMING APPARATUS

(71) Applicant: CANON KABUSHIKI KAISHA, Tokyo (JP)

(72) Inventor: Kohei Mizuguchi, Joso (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/956,004

(22) Filed: Dec. 1, 2015

(65) Prior Publication Data

US 2016/0159588 A1 Jun. 9, 2016

(30) Foreign Application Priority Data

Dec. 3, 2014 (JP) ..... 2014-245210

(51) Int. Cl.
*B65H 85/00* (2006.01)
*B65H 31/02* (2006.01)
(Continued)

(52) U.S. Cl.
CPC ..... *B65H 85/00* (2013.01); *B65H 29/125* (2013.01); *B65H 31/02* (2013.01); *B65H 31/26* (2013.01); *G03G 15/6552* (2013.01); *G03G 21/1633* (2013.01); *B65H 2301/4212* (2013.01); *B65H 2402/31* (2013.01); *B65H 2402/441* (2013.01); *B65H 2403/41* (2013.01); *B65H 2403/945* (2013.01); *B65H 2405/1122* (2013.01); *B65H 2405/11164* (2013.01); *B65H 2511/11* (2013.01); *B65H 2801/06* (2013.01)

(58) Field of Classification Search
CPC .... B65H 31/16; B65H 31/02; B65H 2402/41; B65H 2402/31; B65H 2402/441; B65H 2403/945; B65H 2405/11164; B65H 2405/1122; B65H 2511/11; B65H 85/00; G03G 21/16
USPC ..... 271/9.09; 399/124
See application file for complete search history.

(56) References Cited

U.S. PATENT DOCUMENTS 7,343,118 B2 * 3/2008 Ahn ..... G03G 21/1633 292/DIG. 15
7,708,269 B2 * 5/2010 Nakashima ..... B65H 1/04 271/162
(Continued)

FOREIGN PATENT DOCUMENTS

CN 101082789 A 12/2007
CN 101566810 A 10/2009
(Continued)

*Primary Examiner* — Patrick D Cicchino
(74) *Attorney, Agent, or Firm* — Canon U.S.A., Inc. IP Division

(57) ABSTRACT

A sheet stacking apparatus includes a door pivotable relative to an apparatus main body, a sheet stacking unit, on which sheets are stacked, provided in the door, and a load application unit. When the door is closed, the sheet stacking surface is tilted with one end side located higher than the other end side. When the door is opened, the sheet stacking surface is tilted with the one end side capable of being located lower than the other end side. The stopper portion prevents the sheets on the sheet stacking unit from falling when the door is opened. If the door is opened, the load application unit applies load to a pivot of the door before the sheet stacking surface becomes substantially horizontal.

18 Claims, 11 Drawing Sheets

(51) Int. Cl.

| | |
|---|---|
| ***B65H 29/12*** | (2006.01) |
| ***B65H 31/26*** | (2006.01) |
| ***G03G 21/16*** | (2006.01) |
| ***G03G 15/00*** | (2006.01) |

(56) References Cited

U.S. PATENT DOCUMENTS

| | | | | |
|---|---|---|---|---|
| 7,748,691 | B2 * | 7/2010 | Mizuguchi | B65H 1/04 271/162 |
| 8,028,991 | B2 * | 10/2011 | Hirokawa | B65H 7/00 271/272 |
| 8,087,658 | B2 * | 1/2012 | Ohtsuki | B65H 5/26 271/162 |
| 8,412,056 | B2 * | 4/2013 | Furuichi | G03G 21/16 399/110 |
| 8,699,919 | B2 * | 4/2014 | Takamori | E05F 5/02 312/327 |
| 8,923,728 | B2 * | 12/2014 | Nakazawa | G03G 15/161 399/107 |
| 9,042,770 | B2 * | 5/2015 | Sato | G03G 21/1623 399/107 |
| 2013/0000207 | A1 | 1/2013 | Cook | |
| 2015/0001794 | A1 * | 1/2015 | Doi | B65H 1/04 271/264 |
| 2015/0063858 | A1 * | 3/2015 | Nakamura | G03G 15/2017 399/94 |
| 2016/0161909 | A1 * | 6/2016 | Wada | G03G 21/1633 399/124 |

FOREIGN PATENT DOCUMENTS

| | | | |
|---|---|---|---|
| CN | 102043364 | A | 5/2011 |
| CN | 104249944 | A | 12/2014 |
| JP | H09-190029 | A | 7/1997 |
| JP | 2002274660 | A | 9/2002 |
| JP | 2004009530 | A | 1/2004 |
| JP | 2006-341987 | A | 12/2006 |
| JP | 2010-008967 | A | 1/2010 |
| JP | 2010008872 | A | 1/2010 |
| JP | 2010210755 | A | 9/2010 |
| JP | 2011053630 | A | 3/2011 |
| JP | 2013190627 | A | 9/2013 |

* cited by examiner

SHEET STACKING APPARATUS AND IMAGE FORMING APPARATUS

BACKGROUND OF THE INVENTION

Field of the Invention

The present invention relates to a sheet stacking apparatus on which sheets are stacked and an image forming apparatus provided with the sheet stacking apparatus.

Description of the Related Art

An image forming apparatus forms an image by an image forming unit on a sheet fed from a sheet feed cassette or a manual feed tray. The sheet with the image formed thereon is discharged outside the apparatus by an ejection roller. The sheet discharged outside the apparatus is stacked on a discharge tray.

An image forming apparatus typically has a door to allow access to a conveyance path or a maintenance section for jam clearance and maintenance. The door is opened and closed relative to an apparatus main body about a shaft provided at a lower portion of the apparatus main body.

The door may be provided with a discharge tray (Japanese Patent Laid-Open No. 9-190029 and No. 2010-8967), or a manual feed tray (Japanese Patent Laid-Open No. 2006-341987). In these configurations, the sheets stacked on the discharge tray or the manual feed tray may fall at the time at which the door is opened. Then, in Japanese Patent Laid-Open No. 9-190029, an angle of the discharge tray is adjusted by a link at the time of opening and closing of the door to prevent the sheets from falling. In Japanese Patent Laid-Open No. 2006-341987, a fall prevention claw is provided at an end of the manual feed tray. Ends of the stacked sheets are made to abut against the claw for the fall prevention.

The configuration in which the angle of the discharge tray is adjusted by the link at the time of opening and closing of the door as in Japanese Patent Laid-Open No. 9-190029 becomes complicated.

The configuration in which the fall prevention claw for the sheets is provided in the tray as in Japanese Patent Laid-Open No. 2006-341987 has the following problem: if the door is opened quickly, the sheet may move quickly until being dammed up by the fall prevention claw and may cross over the fall prevention claw, whereby falling of the sheet cannot be prevented. If a distance from the center of the shaft of the door to the tray is long, the tray provided in the door moves quickly at the time at which the door is opened, and the sheet stacked on the tray falls more easily.

SUMMARY OF THE INVENTION

The present invention prevents sheets stacked on a sheet stacking unit provided in a door from falling at the time at which the door is opened with the sheets stacked on the sheet stacking unit.

According to an aspect of the present invention, a sheet stacking apparatus includes a door pivotable relative to an apparatus main body, a sheet stacking unit including a sheet stacking surface which is tilted with one end side located higher than the other end side when the door is closed, on which sheets are stacked, and which is tilted with the one end side capable of being located lower than the other end side when the door is opened, the sheet stacking unit being provided in the door, and a load application unit configured to apply load to a pivot of the door before the sheet stacking surface becomes substantially horizontal in a case that the door is opened.

Further features of the present invention will become apparent from the following description of exemplary embodiments with reference to the attached drawings.

DESCRIPTION OF THE EMBODIMENTS

Figure 1:
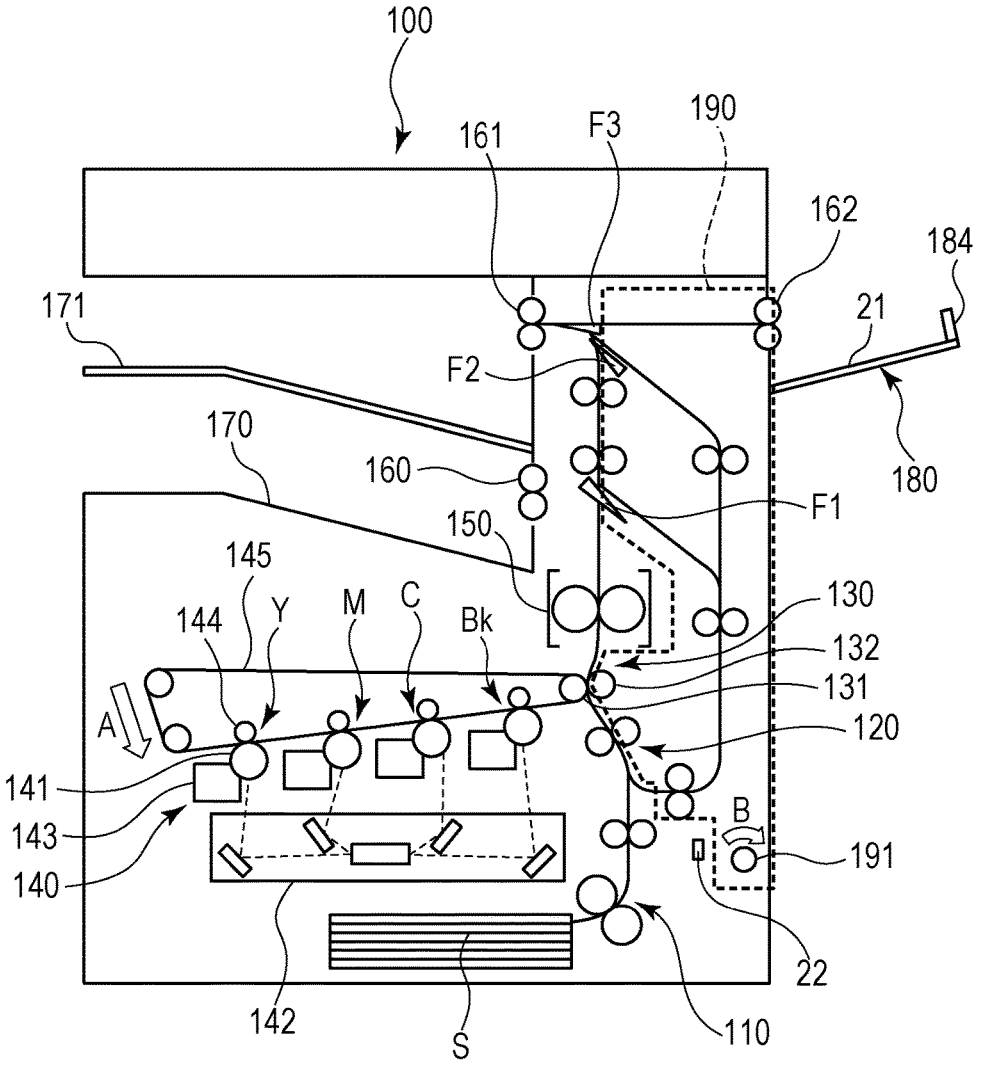
FIG. 1 is a cross-sectional view of an image forming apparatus according to the present invention.

FIG. 1 is a cross-sectional view of an intermediate transfer tandem system image forming apparatus according to the present embodiment in which a plurality of image forming stations corresponding to each of four colors are arranged on an intermediate transfer belt.

A sheet S is fed by a sheet feeding unit 110 at image formation timing of the image forming apparatus. The sheet S fed by the sheet feeding unit 110 passes through a conveyance path, and is conveyed to a skew correction apparatus 120. After being subject to skew correction and timing correction in the skew correction apparatus 120, the sheet S is sent to a secondary transfer portion 130. The secondary transfer portion 130 is constituted by a secondary transfer inner roller 131 and a secondary transfer outer roller 132 which substantially face each other. The toner image is transferred to the sheet S under predetermined pressure force and electrostatic load bias while being nipped by these rollers 131 and 132.

An image formation process performed in parallel with a conveyance process of the sheet S to the secondary transfer portion 130 described above is described.

In accordance with signals of transmitted image information, an exposure apparatus 142 emits light to a photosensitive member 141 of which surface is charged uniformly by a charging unit, and an electrostatic latent image is formed on the photosensitive member 141 via a diffraction unit and the like suitably. Toner development is performed by a developing unit 143 to the electrostatic latent image formed on the photosensitive member 141, and then a toner image is formed on the photosensitive member 141.

Then, predetermined pressure force and electrostatic load bias are applied by a primary transfer apparatus 144 to transfer the toner image to an intermediate transfer belt 145. In the case of FIG. 1, four image forming stations each including the photosensitive member 141, the exposure apparatus 142, the developing unit 143, and the primary transfer apparatus 144 described above are provided. Each of the image forming stations is provided for yellow Y, magenta M, cyan C, and black Bk.

Next, the intermediate transfer belt 145 is described. The intermediate transfer belt 145 is driven to be conveyed in the direction of arrow A in FIG. 1. Therefore, the intermediate transfer belt 145 is processed in parallel at the image forming stations of Y, M, C, and Bk. The image formation process of each color is performed at timing at which a subsequent toner image overlaps an upstream toner image primarily transferred to the intermediate transfer belt 145. Finally, a full color toner image is formed on the intermediate transfer belt 145 and is conveyed to the secondary transfer portion 130.

As described above, a full color toner image is secondarily transferred to the sheet S in the secondary transfer portion 130 by the conveyance process of the sheet S and the image formation process. The sheet S is then conveyed to a fixing unit 150. The fixing unit 150 causes the toner to melt with heat from a heat source of a heater or the like, and be fixed to the sheet S while pressurizing the sheet S with predetermined pressure force by the opposing rollers. The image forming unit 140 is constituted by the photosensitive member 141, the exposure apparatus 142, the developing unit 143, the primary transfer apparatus 144, the intermediate transfer belt 145, and the fixing unit 150.

The conveyance path of the sheet S with the image fixed thereto by the fixing unit 150 is switched by a first switching member F1. Then the sheet S is discharged to a first discharge tray 170 by first discharge rollers 160, or discharged to a second discharge tray 171 by second discharge rollers 161. In some cases, the sheet S to which the image is fixed and which is proceeding toward the second discharge rollers 161 is inverted by an inversion operation of the second discharge rollers 161, and is discharged via a third switching member F3 to a third discharge tray 180 by third discharge rollers 162 described later. In some cases, the conveyance path of the sheet S inverted by the second discharge rollers 161 is switched by the third switching member F3. The sheet S is then fed to a re-conveyance path for image formation on the back side thereof by the image forming unit 140 again.

Next, a configuration of a door 190 provided in an image forming apparatus body 100 (hereafter, referred to as an apparatus main body) is described.

The dashed line in FIG. 1 represents an outline of the door 190 that is pivotable relative to the apparatus main body 100. The door 190 is pivotally supported about a shaft 191 as a pivoting center relative to the apparatus main body 100. The door 190 is kept closed (i.e., at a closed position) where a hook portion of the door 190 is hooked on a hook rest provided on the apparatus main body 100. The door 190 can be opened in the direction of arrow B outside the apparatus main body when the hook portion is released from the hook rest as a handle of the door 190 is pulled. An open angle of the pivoted door 190 is regulated at a predetermined angle by a regulating unit 22 that regulates the pivot of the door 190 in contact with the door 190, and is held by the regulating unit 22 at the predetermined angle. When the door 190 is kept open, a space allowing access to the main conveyance path for jam clearance or access to the inside of the apparatus main body 100 for parts replacement is provided.

The door 190 is provided with a third discharge unit constituted by the third discharge rollers 162 and the third discharge tray 180 as a sheet tray of the present embodiment.

The sheet S discharged by the third discharge rollers 162 is discharged on an upper surface (i.e., a sheet stacking surface) 21 of the third discharge tray 180 as a sheet stacking unit on which the sheets S are stacked.

Figure 2:
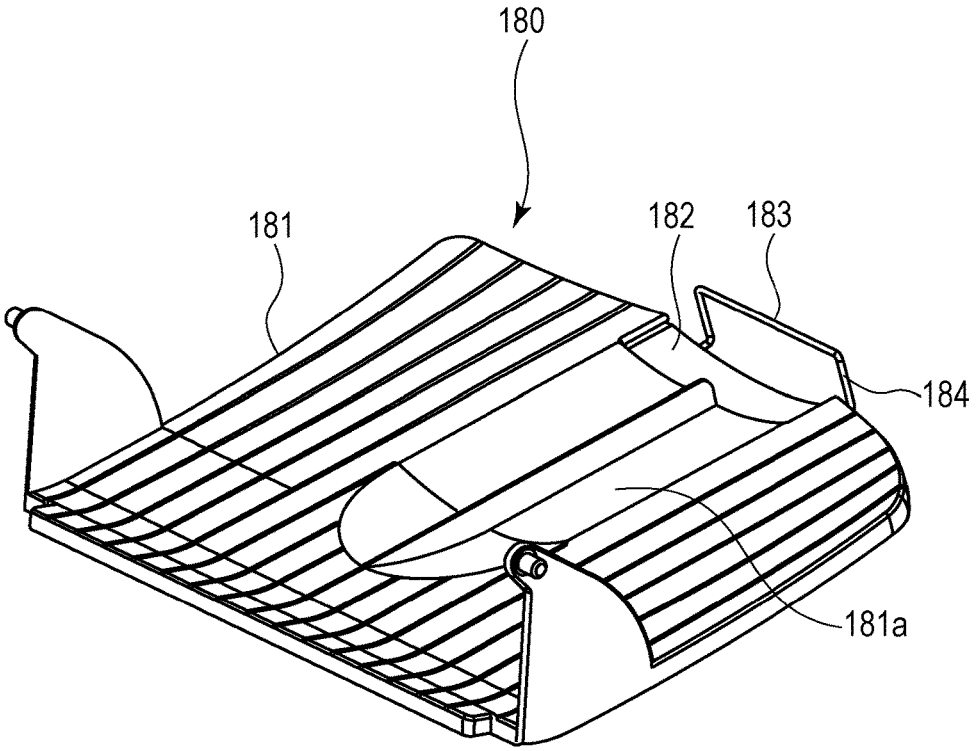
FIG. 2 is a perspective view of a third discharge tray of the image forming apparatus according to the present invention.
Figure 3:
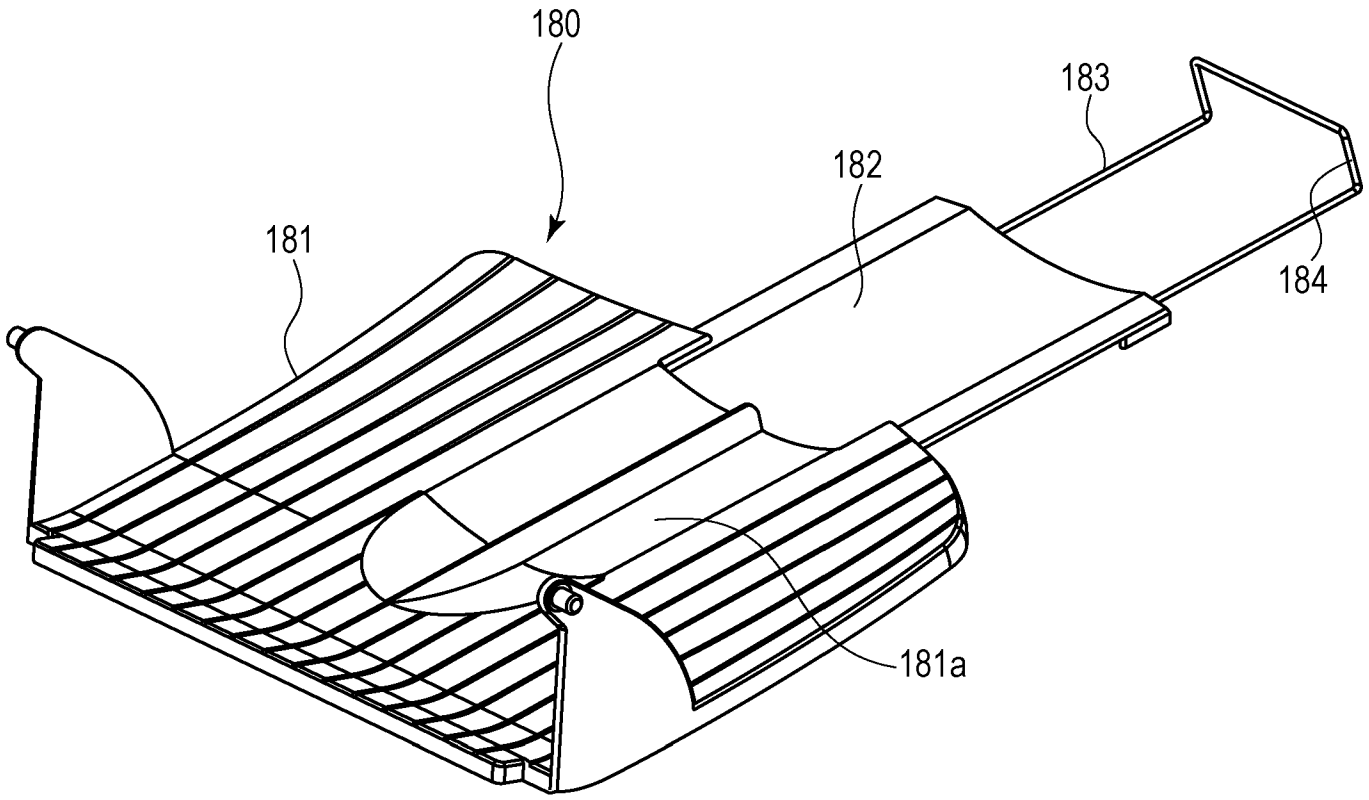
FIG. 3 is a perspective view of the third discharge tray of the image forming apparatus according to the present invention.

As illustrated in the perspective views of FIGS. 2 and 3, the third discharge tray 180 includes a third discharge base tray 181 attached to the door 190, and a third discharge extension tray 182 provided to be slidable (i.e., movable) relative to the third discharge base tray 181. The third discharge tray 180 includes a third discharge stopper tray 183 provided to be slidable (i.e., movable) relative to the third discharge extension tray 182 and includes a stopper portion 184. When the door 190 is opened with the sheets S stacked on the third discharge tray 180, ends of the sheets S which are about to fall from the third discharge tray 180 abut against the stopper portion 184, and the sheets S are dammed up by the stopper portion 184. A recess 181*a* is formed at the center of the third discharge base tray 181 in the width direction that perpendicularly crosses the discharge direction of the sheet S. The sheet S bends along the recess 181*a* so that the end of the sheet S easily abuts against the stopper portion 184.

The present embodiment is applicable to the sheet S of any length (i.e., size) to be discharged on the third discharge tray 180 by sliding the third discharge extension tray 182 and the third discharge stopper tray 183.

Figure 4:
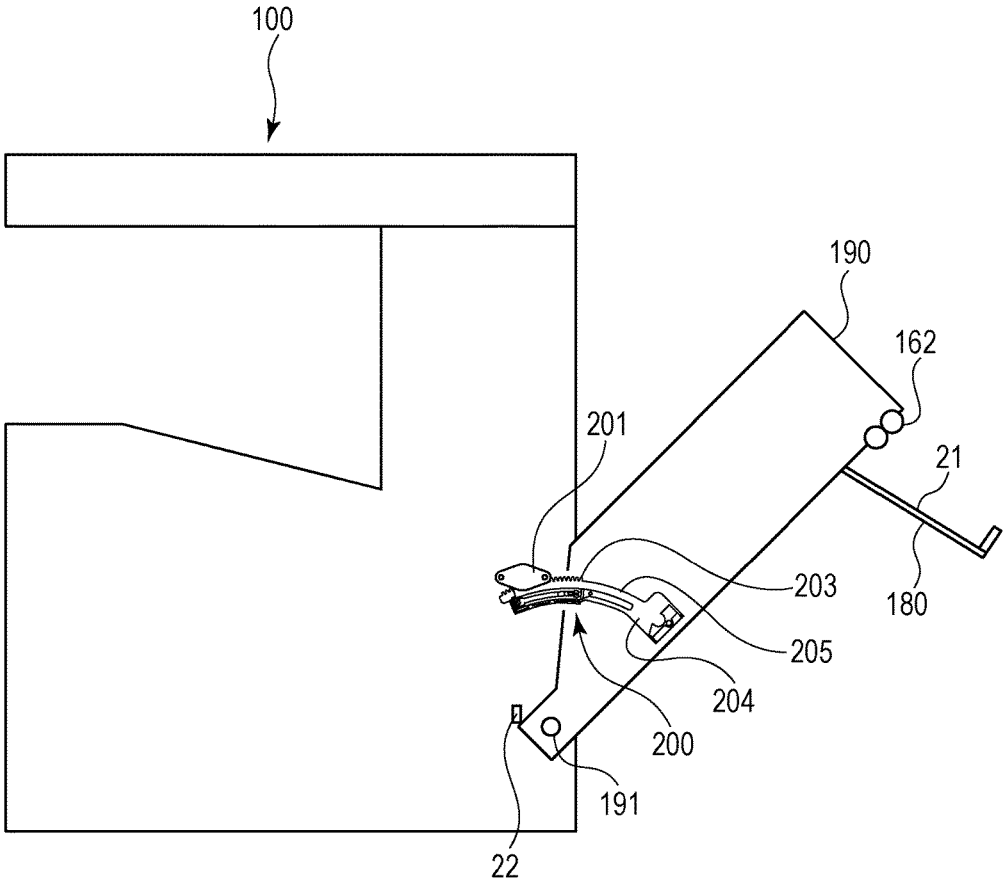
FIG. 4 is a front view of the image forming apparatus according to the present invention in which a damper unit is disposed.
Figure 5:
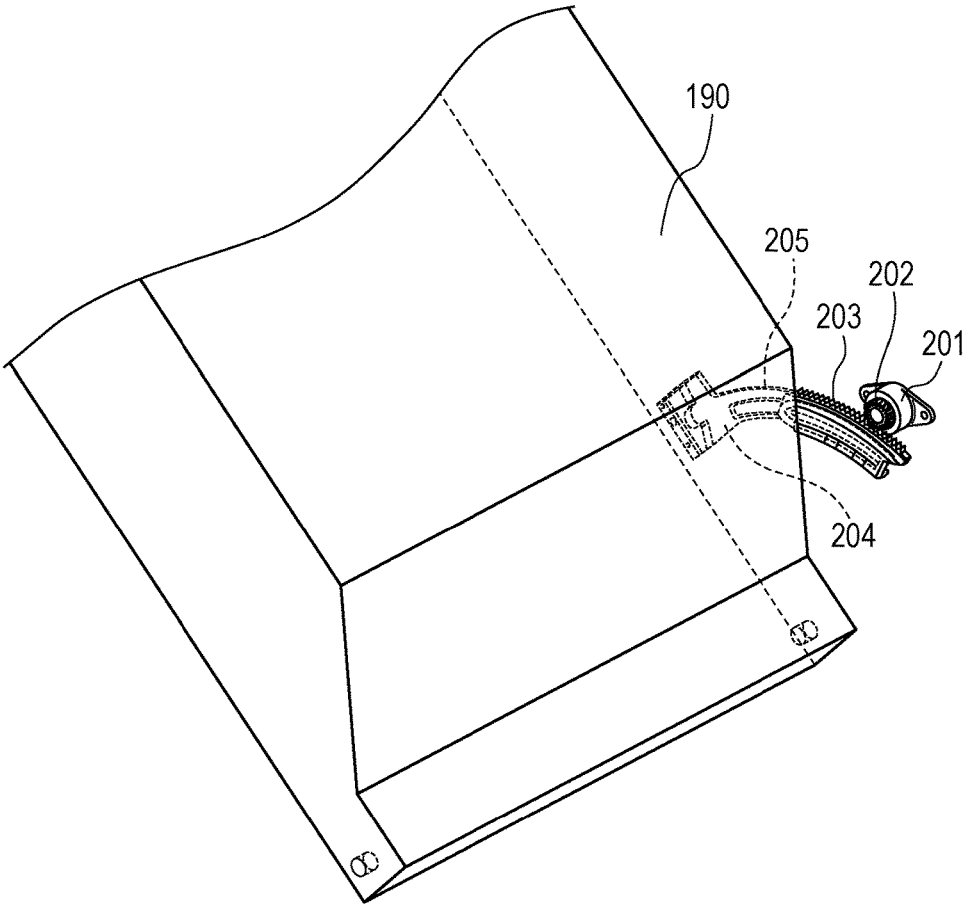
FIG. 5 is a perspective view of the damper unit.

As illustrated by FIGS. 4 and 5, a damper unit 200 as a load application unit for applying resistance (i.e., load) to the movement of the door 190 when the door 190 is opened and closed is provided in the apparatus main body 100. FIG. 4 is a front view of the image forming apparatus, and FIG. 5 is a perspective view of the image forming apparatus seen from the back side. The damper unit 200 is provided in the apparatus main body 100, and is constituted by a rotary damper 201 having a pinion gear 202, and a rack member 204 provided in the door 190 and having a rack gear 203.

The rack member 204 includes a gear teeth-less portion 205. When the pinion gear 202 is located opposite to the gear teeth-less portion 205 of the rack member 204 and the rack gear 203 and the pinion gear 202 do not engage with each other, the rotary damper 201 of the damper unit 200 applies no resistance (i.e., load) to the pivot of the door 190. When the pinion gear 202 as a damper gear engages with the rack gear 203 of the rack member 204, the rotary damper 201 applies load to the pivot of the door 190. In the present embodiment, after a predetermined idling section (i.e., a section in which the rotary damper 201 applies no resistance) from the state where the door 190 is closed (i.e., a closed position), the pinion gear 202 engages with the rack gear 203 of the rack member 204 to apply load to the pivot of the door 190. Hereinafter, the damper unit 200 applying load to the pivot of the door 190 is referred to as "the damper unit 200 exerts a damper action" or "resistance to the door 190 by the damper unit 200 takes effect." A relationship between an opening and closing angle of the door 190 and an idling section in which the gear teeth-less portion 205 is located opposite to the pinion gear 202 or a section in which the pinion gear 202 engages with the rack gear 203 and the damper action of the damper unit 200 takes effect is described with reference to FIGS. 6A to 9B.

FIGS. 6A to 9B sequentially illustrate the conditions since the door 190 is closed until the door 190 is stopped at the open position by being held by the regulating unit 22.

Figure 6A:
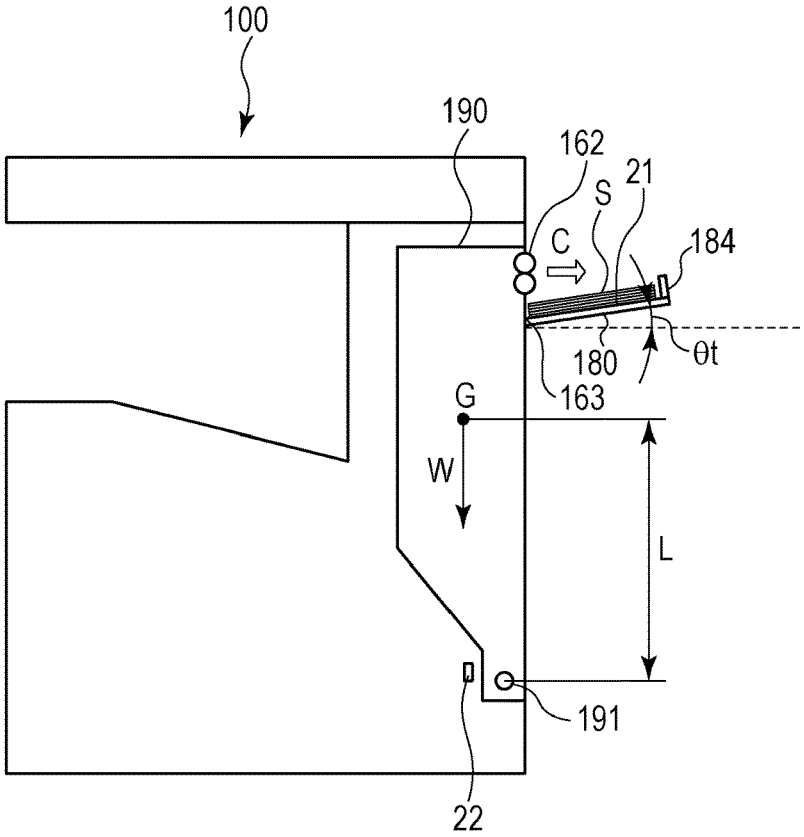
FIG. 6A is a front view of the image forming apparatus according to the present invention when a door is closed.
Figure 6B:
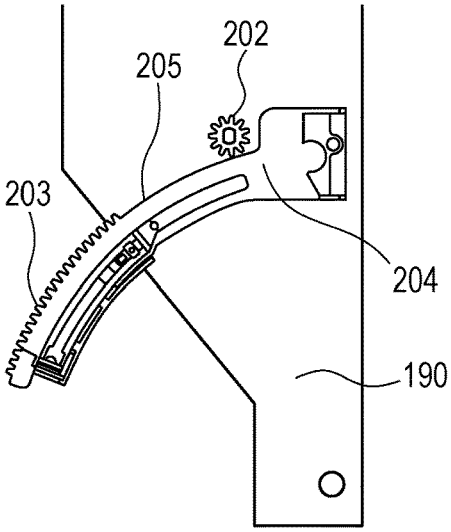
FIG. 6B illustrates a positional relationship between a rack member and a pinion gear when the door is closed.

FIG. 6A is a front view of the image forming apparatus when the door 190 is closed. FIG. 6B illustrates a positional relationship between the rack member 204 and the pinion gear 202 when the door 190 is closed. As illustrated in FIG. 6A, the gravity W which is self weight is applied to the centroid G at the position separated by a distance L from the center of the shaft 191 of the door 190 in the vertical direction. When the door 190 is located at the closed position as illustrated in FIGS. 6A and 6B, the upper surface 21 (i.e., a sheet stacking surface on which the sheets S are stacked) of the third discharge tray 180 is tilted by a predetermined tray angle θt to the horizontal direction illustrated by the dashed line so that the downstream of a conveyance direction C is located upward. A plurality of sheets S discharged from the third discharge rollers 162 are stacked on the third discharge tray 180. When discharged on the third discharge tray 180, the sheet S moves by self weight along the upper surface 21 of the third discharge tray 180 tilted by the predetermined tray angle θt, and the end on the apparatus main body 100 side (i.e., the upstream end in the discharge direction) abuts against a sheet stacking wall 163. Therefore, the ends of the sheets S stacked on the third discharge tray 180 on the apparatus main body 100 side abut against the sheet stacking wall 163. In the present embodiment, the end of the sheet S on the third discharge tray 180 and the stopper portion 184 are separated from each other.

Figure 7A:
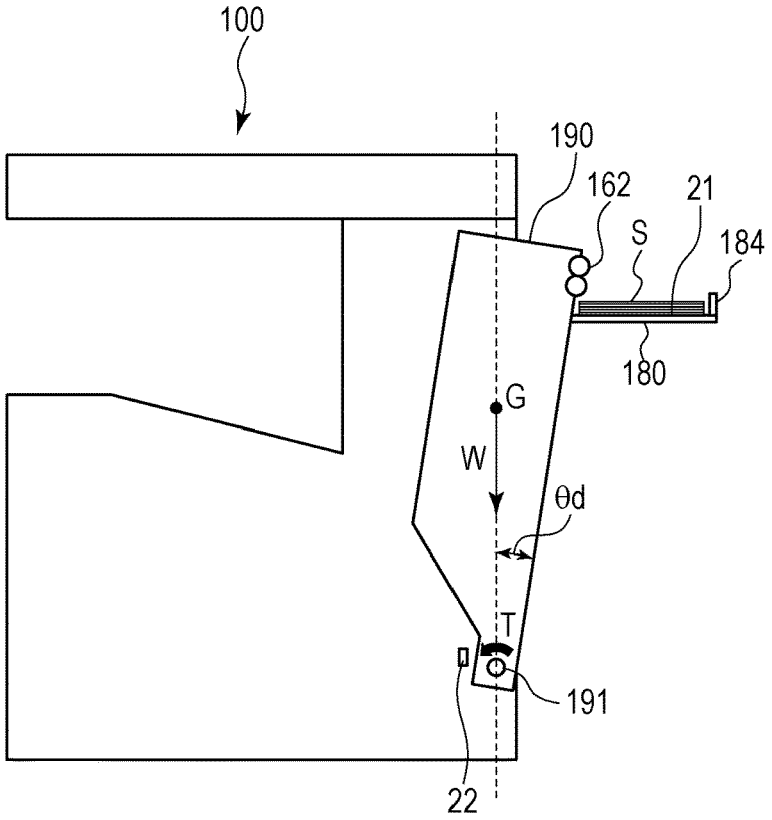
FIG. 7A is a front view of the image forming apparatus according to the present invention when a damper of the door begins to take effect.
Figure 7B:
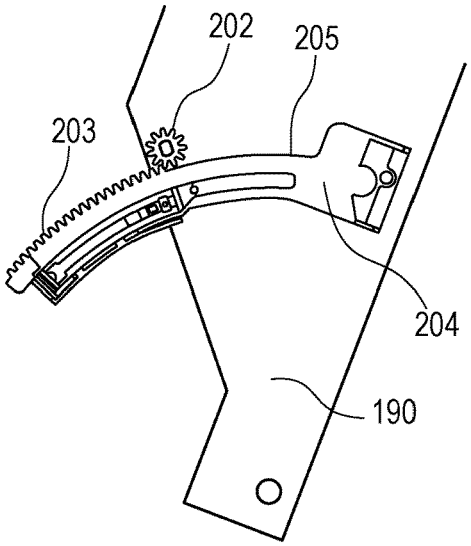
FIG. 7B illustrates a positional relationship between the rack member and the pinion gear when the damper of the door begins to take effect.

FIGS. 7A and 7B each illustrate a state immediately before the door 190 begins to open and resistance T to the door 190 applied by the damper unit 200 begins to take effect. FIG. 7A is a front view of the image forming apparatus. FIG. 7B illustrates a positional relationship between the rack member 204 and the pinion gear 202. FIGS. 7A and 7B illustrate a state where the door 190 is opened by a door angle θd from the closed state. In FIGS. 7A and 7B, the centroid G of the door 190 is on the vertical line illustrated by the dashed line passing through the shaft 191. The damper unit 200 is set to begin application of the resistance T to the door 190 when the door 190 is further opened from the state of FIGS. 7A and 7B and the centroid G of the door 190 illustrated by the dashed line passing through the shaft 191 just exceeds the vertical line. When the damper unit 200 begins to apply the resistance T to the door 190, the third discharge tray 180 is substantially horizontal. Therefore, when the door 190 is to be further opened from the state of FIGS. 7A and 7B, the door 190 is opened slowly by self weight against the resistance T by the damper unit 200.

When the door 190 is further opened from the state of FIGS. 7A and 7B, the upper surface 21 of the third discharge tray 180 is soon tilted so that a downstream end of the sheet S in the conveyance direction C (i.e., an end that abuts against the stopper portion 184) is located downward. Therefore, although the sheet S stacked on the third discharge tray 180 is about to fall due to the tilt of the third discharge tray 180 as the door 190 is opened, the stopper portion 184 can dam up the sheet S which is about to fall due to the tilt of the third discharge tray 180.

Figure 8A:
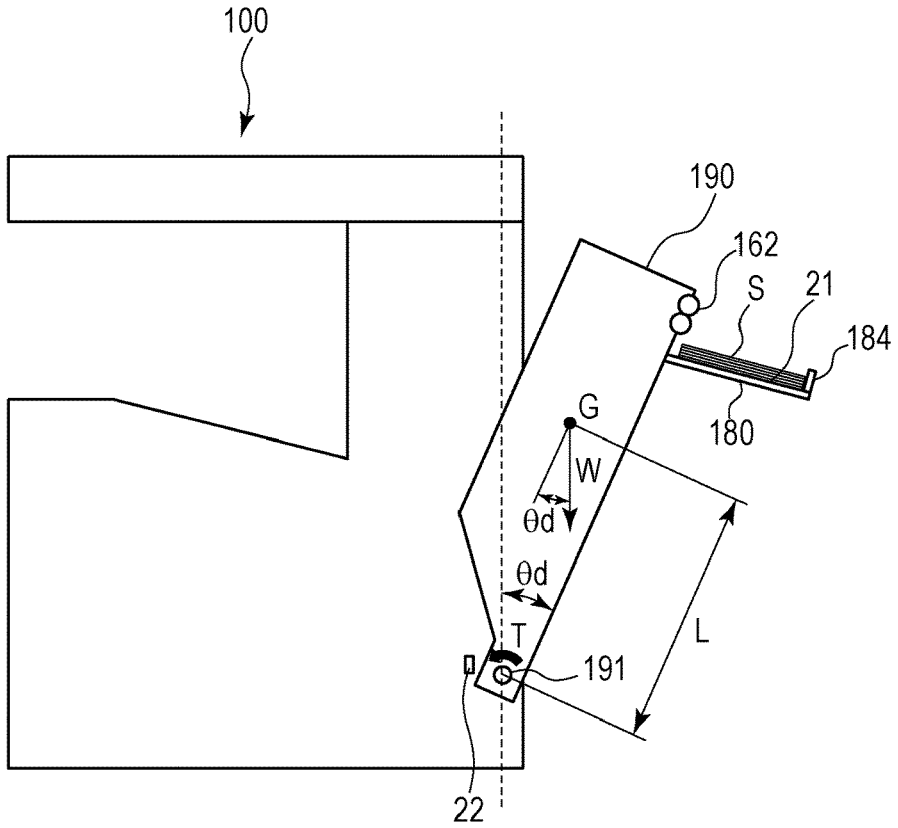
FIG. 8A is a front view of the image forming apparatus according to the present invention in a state where the door is being opened against the resistance by the damper.
Figure 8B:
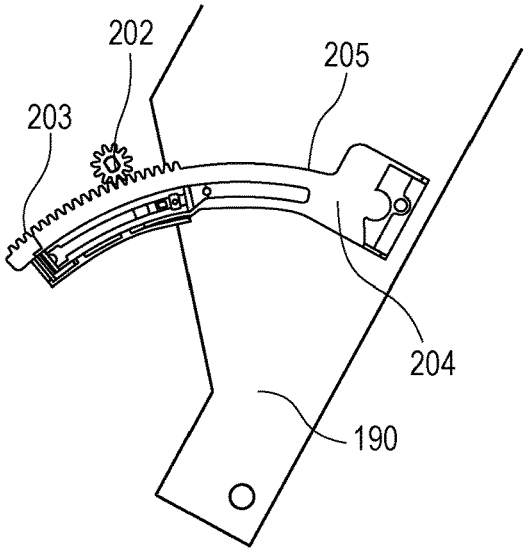
FIG. 8B illustrates a positional relationship between the rack member and the pinion gear in a state where the door is being opened against the resistance by the damper.

FIGS. 8A and 8B illustrate a state where the door 190 is being opened against the resistance T by the damper unit 200, and the stopper portion 184 dams up the sheets S on the third discharge tray 180. FIG. 8A is a front view of the image forming apparatus. FIG. 8B illustrates a positional relationship between the rack member 204 and the pinion gear 202. After the resistance T to the door 190 by the damper unit 200 takes effect as described above, the third discharge tray 180 is tilted such that the downstream end of the third discharge tray 180 in the conveyance direction C is located downward. Therefore, after the resistance T to the door 190 by the damper unit 200 takes effect, the sheets S move in the direction opposite to the apparatus main body 100 along the upper surface 21 of the discharge tray 180 due to the tilt of the third discharge tray 180. When the sheets S move along the tilted third discharge tray 180, the resistance T (i.e., the load) is applied to the door 190 by the damper unit 200.

Torque of the rotary damper 201 is set so that the resistance T by the damper unit 200 becomes small relative to the moment by the gravity W which is self weight of the door 190. That is, the following relational expression holds: $WL \sin \theta d > T$. Therefore, even if an operator releases his/her hand from the door 190, the door 190 is continuously opened slowly by self weight against the resistance T by the damper unit 200 from the state of FIGS. 7A and 7B.

If the door 190 is opened under operating force in the open direction by the operator, the damper unit 200 prevents the door 190 from being moved significantly quick. Therefore, the following situation less often occurs in which, when the door 190 is opened quickly by the operator, the sheets S on the third discharge tray 180 cross over the stopper portion 184 and fall from the third discharge tray 180.

Figure 9A:
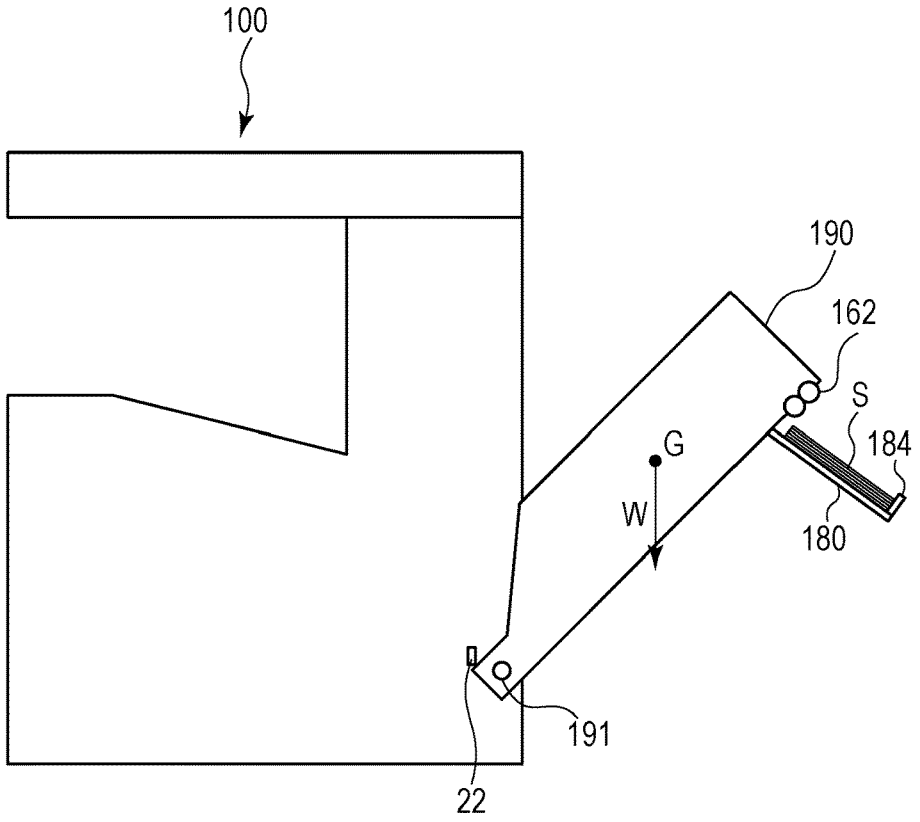
FIG. 9A is a front view of the image forming apparatus according to the present invention when the door is stopped at the open position.
Figure 9B:
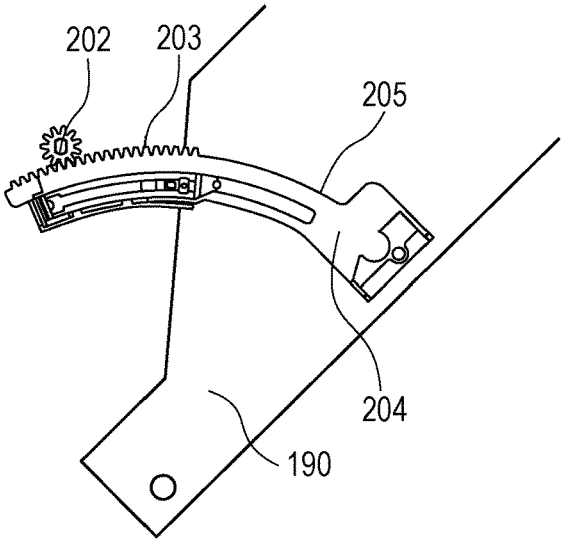
FIG. 9B illustrates a positional relationship between the rack member and the pinion gear when the door is stopped at the open position.

FIG. 9A is a front view of the image forming apparatus in a state where the door 190 is stopped by the regulating unit 22 at the open position. FIG. 9B illustrates a positional relationship between the rack member 204 and the pinion gear 202 in the state where the door 190 is stopped at the open position. As illustrated in FIGS. 9A and 9B, when the door 190 is located at the open position, a space for jam clearance and the like can be provided. Impact caused when the door 190 is stopped by the regulating unit 22 is diminished by a damper action of the damper unit 200. Therefore, the following situation also less often occurs in which the sheets S on the third discharge tray 180 move greatly and cross over the stopper portion 184 due to impact caused when the pivot of the door 190 is stopped by the regulating unit 22.

When the door 190 is opened as illustrated in FIGS. 9A and 9B, the downstream side of the third discharge tray 180 in the conveyance direction C is tilted greatly from the horizontal direction, and the sheets S stacked thereon are tilted in the direction to fall. However, since the state where the sheets S are dammed up by the stopper portion 184 is kept, the sheets S can be held without falling from the third discharge tray 180.

As described above, the image forming apparatus as the sheet stacking apparatus on which the sheets S are stacked includes the stopper portion 184 that dams up the sheets S and is provided in the third discharge tray 180, and the damper unit 200 that applies the resistance T in the open and close direction when the door 190 is opened and closed. The resistance T applied by the damper unit 200 can reduce the speed at which the door 190 is opened. Therefore, even if the door 190 is opened with the sheets S stacked on the third discharge tray 180, since the sheets S which are about to fall can be dammed up reliably by the stopper portion 184, the sheets S hardly fall from the third discharge tray 180.

In the present embodiment, the damper unit 200 exerts the damper action when the third discharge tray 180 becomes substantially horizontal. Here, "the third discharge tray 180 becomes substantially horizontal" refers to a state in which the sheets S on the third discharge tray 180 do not move by self weight along the third discharge tray 180. At the timing at which the third discharge tray 180 becomes substantially horizontal, that is, before the timing at which the sheets S begin to move along the third discharge tray 180 tilted so that the downstream end in the conveyance direction C is located downward, the damper unit 200 exerts the damper action. Therefore, the sheets S can be dammed up reliably by the stopper portion 184.

The damper unit 200 takes effect from the position at which, after the door 190 is moved a predetermined idling distance from the closed state, the centroid G of the door 190 exceeds the vertical line passing through the shaft 191. Therefore, the resistance T by the damper unit 200 has no influence on the operation force generated when the door 190 is opened to release the hook portion keeping the closed state, or when the door 190 is closed to engage the hook portion. Further, the resistance T in the open and close direction of the door 190 by the damper unit 200 is set to become small relative to the moment by self weight of the door 190. Therefore, the door 190 is opened by self weight without stop, even if the operator releases his/her hand from the door 190 during the opening or closing of the door 190. Thus, the above-described operation and effect are exerted by the damper unit 200 and, at the same time, usability about opening and closing of the door 190 is high.

In the present embodiment, the resistance T by the damper unit 200 takes effect when the tilt of the third discharge tray 180 becomes substantially horizontal. Here, the state where "the third discharge tray 180 becomes substantially horizontal" includes the following state where the third discharge tray 180 is substantially horizontal: a state where the third discharge tray 180 is tilted with the downstream side in the conveyance direction C located downward but the sheets S do not move along the upper surface of the third discharge tray 180.

In the present embodiment, the tilt of the third discharge tray 180 becomes substantially horizontal at the same time as the resistance T by the damper unit 200 takes effect. However, the third discharge tray 180 may be located at a position before becoming substantially horizontal, that is, the downstream side of the third discharge tray 180 in the conveying direction may be tilted upward from the horizontal direction. It is only necessary that the damper unit 200 exerts the damper action on the door 190 before the sheets S on the third discharge tray 180 begins to move (i.e., fall) along the third discharge tray 180 due to the tilt of the third discharge tray 180. That is, it is desirable that the damper unit 200 begins to apply load to the pivot of the door 190 after the door 190 begins to open and before the third discharge tray 180 becomes substantially horizontal. More desirably, an angle θt at which the third discharge tray 180 is tilted in the horizontal direction is greater than an angle θd at which the door 190 is opened by the time the damper unit 200 exerts the damper action.

In the form in which the resistance T by the damper unit 200 takes effect when the tilt of the third discharge tray 180 becomes substantially horizontal has been described. However, the resistance T by the damper unit 200 may take effect after the tilt of the third discharge tray 180 becomes substantially horizontal. Also in this case, the impact caused when the door 190 is stopped by the regulating unit 22 at the open position is diminished by the damper action of the damper unit 200, whereby the sheets S hardly cross over the stopper portion 184. Usability of this case is high in that the region where the resistance T by the damper unit 200 in the pivoting region of the door 190 takes effect is small and, therefore, the user can move the door 190 to the open position quickly.

In any of the above forms, the resistance T by the damper unit 200 takes effect in a part of the pivoting region from the closed position (FIG. 6) to the open position (FIG. 9) of the door 190. However, the resistance T by the damper unit 200 may take effect in the entire region from the closed position to the open position. In this case, since the pivoting speed of the door 190 can be lowered as compared with a case where the resistance T by the damper unit 200 takes effect in a part of the pivoting region, the sheets S can be prevented from crossing over the stopper portion 184 more reliably.

Although the damper unit 200 is formed by the rotary damper 201, other systems that lower the speed at which the door 190 opens may be used.

As the rotary damper 201, a damper which applies load unidirectionally, that is, applies load to the door 190 when the door 190 pivots in the open direction, and applies no load when the door 190 pivots in the close direction may be used. The damper in this case has high usability because the closing operation of the door 190 becomes easy.

Figure 10:
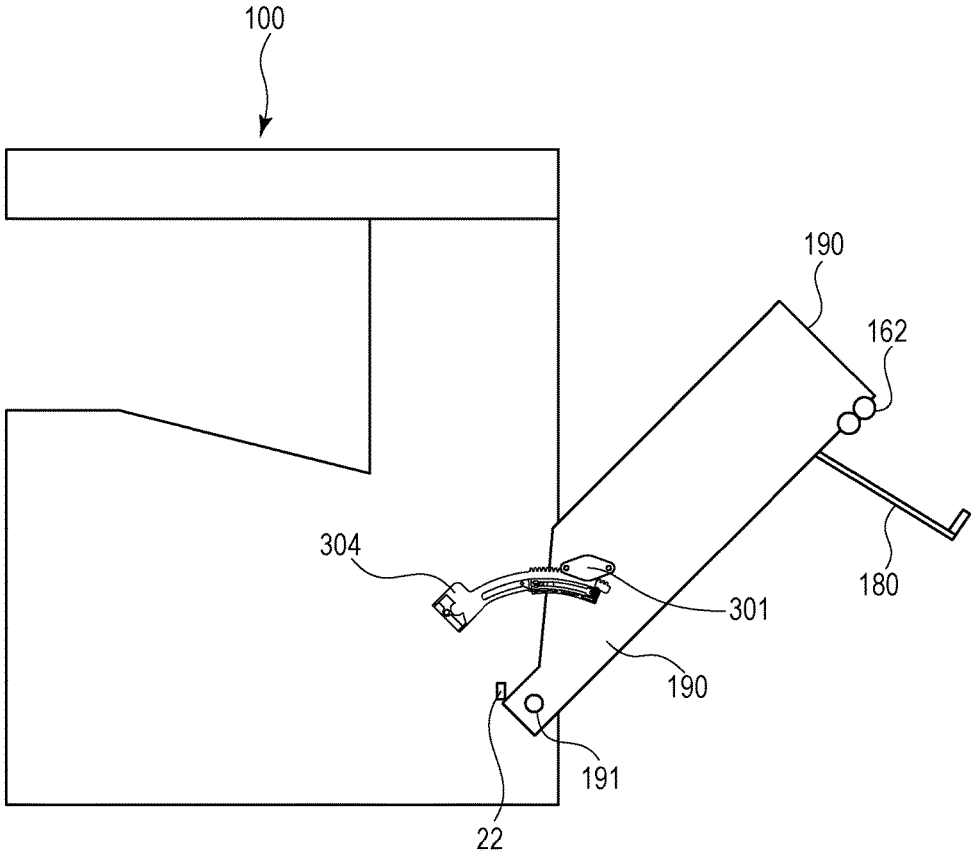
FIG. 10 illustrates a modification.

In the above embodiment, a form in which the rack member is provided in the door 190 and the rotary damper is provided in the apparatus main body 100 has been described. It is only necessary, however, to provide a rotary damper including a pinion gear at one of the apparatus main body 100 and the door 190, and to provide a rack which engages with the pinion gear in the other. That is, as in the modification illustrated in FIG. 10, a rotary damper 301 including a pinion gear may be provided in a door 190, and a rack member 304 including a rack gear which engages with the pinion gear may be provided in an apparatus main body 100.

Figure 11:
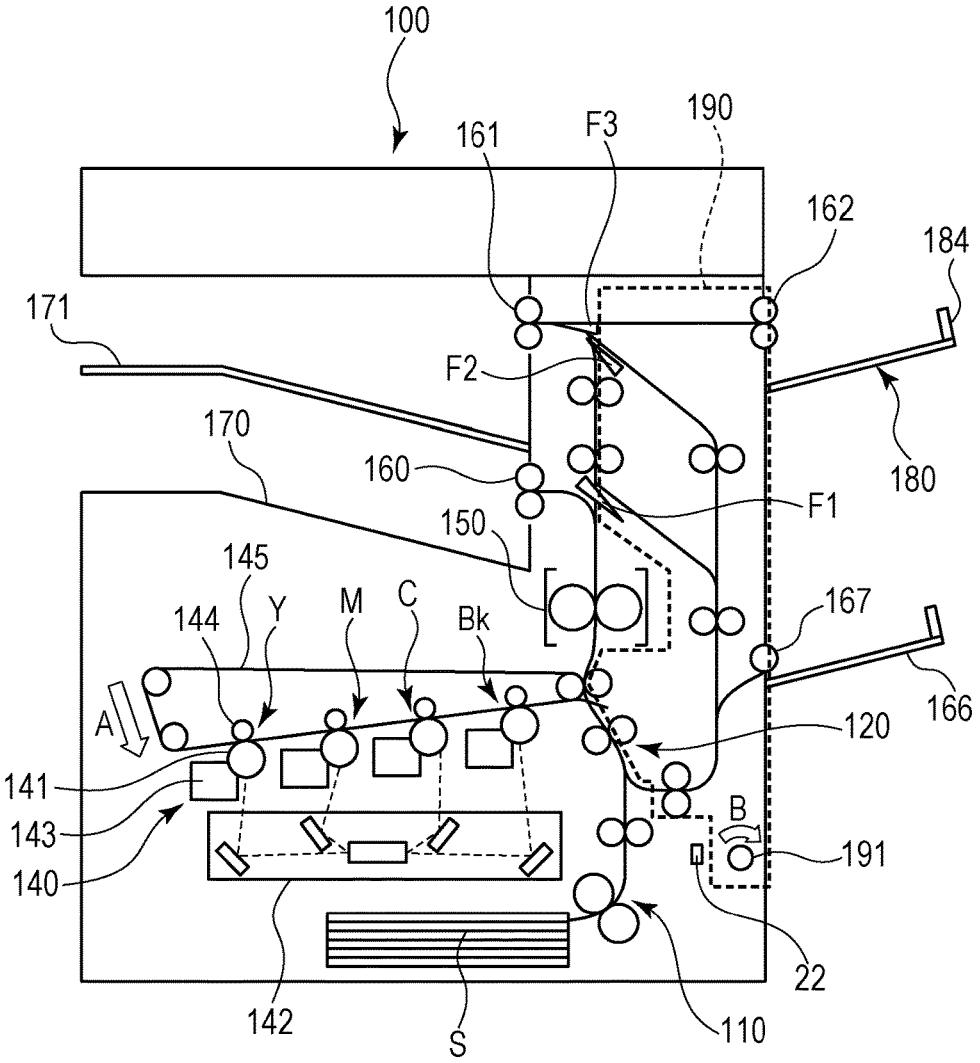
FIG. 11 illustrates a modification.

Although the third discharge tray 180 is described as the sheet stacking unit provided in the door in the present embodiment, this configuration is not restrictive. The present invention is applicable to any configurations in which a sheet stacking unit is provided in a door opened and closed relative to an apparatus main body of a sheet stacking apparatus on which sheets are stacked. For example, the present invention is applicable to a configuration in which, as illustrated in FIG. 11 as a modification, a manual feed tray 166 is provided in the door 190 as a sheet stacking unit. Sheets on which images are to be formed are stacked on the manual feed tray 166 and fed by a feed roller 167. The present invention is applicable also to a discharge tray provided in a door openable and closable relative to a main body of a post-processing apparatus which performs post-processes, such as a folding process and a binding process, on a sheet on which an image is formed.

Although an electrophotographic image forming unit has been described as an example of the image forming unit which forms an image on a sheet, the present invention is applicable also to an image forming apparatus provided with an inkjet image forming unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-245210, filed Dec. 3, 2014, which is hereby incorporated by reference herein in its entirety.

What is claimed is:

1. A sheet stacking apparatus comprising:

a door pivotable about a pivot relative to an apparatus main body;

a sheet stacking unit provided in the door, wherein the sheet stacking unit includes a sheet stacking surface onto which sheets are to be stacked, and wherein one end of the sheet stacking surface is located higher than the other end of the sheet stacking surface in a state in which the door is at a closure position, and the one end of the sheet stacking surface can be located lower than the other end of the sheet stacking surface in a state in which the door is opened from the closure position; and a resistance application unit configured to apply resistance against the pivot of the door being moved to be opened, wherein the resistance application unit is configured to apply no resistance to the pivot of the door which is at any position in a first area, and to apply resistance to the pivot of the door which is at any position in a second area, wherein the first area is between the closure position and a first position where the door pivots from the closure position by a first angle, and the second area is an area where the door pivots to be opened over the first position, wherein, in a state in which the door is at the closure position, a centroid of the door is located on a first side of a vertical line passing through a center of the pivot, wherein, when the centroid of the door is located on the vertical line passing through the center of the pivot, the door is in the first area, wherein, in a state in which the door is at the first position, the one end of the sheet stacking surface is located higher than the other end of the sheet stacking surface and the centroid of the door is located on a second side of the vertical line passing through the center of the pivot and a self-weight of the door acts on the door in a direction moving from the first position to the second area, wherein, in a state in which the door is at a second position in the second area, the sheet stacking surface is horizontal, and wherein, in a state in which the door is at a third position in the second area, the one end of the sheet stacking surface is located lower than the other end of the sheet stacking surface.

2. The sheet stacking apparatus according to claim 1, wherein the resistance application unit applies resistance to the door, and wherein the resistance is smaller than moment applied to the door by weight of the door.

3. The sheet stacking apparatus according to claim 1, further comprising a regulating unit configured to regulate the pivot of the door, wherein, the second area is between the first position and a position where the pivot of the door is regulated by the regulating unit.

4. The sheet stacking apparatus according to claim 1, wherein an angle between the sheet stacking surface of the sheet stacking unit in a state in which the door is at the closure position and a horizontal direction is greater than the first angle.

5. The sheet stacking apparatus according to claim 1, wherein the resistance application unit includes a damper gear provided at one of the door and the apparatus main body, and a rack gear provided at the other of the door and the apparatus main body, and wherein the damper gear and the rack gear engage with each other.

6. The sheet stacking apparatus according to claim 5, wherein the damper gear and the rack gear engage with each other when the door is in the second area, and the damper gear and the rack gear do not engage each other when the door is in the first area.

7. The sheet stacking apparatus according to claim 1, wherein the resistance application unit applies no resistance to the pivot of the door being closed toward the closure position.

8. The sheet stacking apparatus according to claim 1, further comprising a stopper portion configured to abut against an end of the sheets on the one end side on the sheet stacking surface to prevent the sheets on the sheet stacking unit from falling at a time at which the door is opened.

9. The sheet stacking apparatus according to claim 8, wherein the stopper portion is provided in the sheet stacking unit to be movable in accordance with a size of the sheet.

10. The sheet stacking apparatus according to claim 1, wherein a sheet with an image formed thereon is stacked on the sheet stacking unit.

11. The sheet stacking apparatus according to claim 1, wherein a sheet to be fed toward an image forming unit, configured to form an image on the sheet, is stacked on the sheet stacking unit.

12. The sheet stacking apparatus according to claim 1, wherein, in the case that the door is opened, the resistance application unit is configured to apply resistance to the pivot of the door just before the sheet stacking surface becomes substantially horizontal and, prior to just before the sheet stacking surface becomes substantially horizontal, the resistance application unit is configured to apply no resistance to the pivot of the door.

13. The sheet stacking apparatus according to claim 1, wherein torque of a rotary damper of the resistance application unit is set so that the resistance by the damper unit becomes small relative to a moment by the self-weight of the door applied to a centroid of the door.

14. An image forming apparatus comprising:

an image forming unit configured to form an image on a sheet;

an apparatus main body provided with the image forming unit;

a door pivotable about a pivot relative to an apparatus main body;

a sheet stacking unit provided in the door, wherein the sheet stacking unit includes a sheet stacking surface onto which sheets are to be stacked, and wherein one end of the sheet stacking surface is located higher than the other end of the sheet stacking surface in a state in which the door is at a closure position, and the one end of the sheet stacking surface can be located lower than the other end of the sheet stacking surface in a state in which the door is opened from the closure position; and a resistance application unit configured to apply resistance against the pivot of the door being moved to be opened, wherein the resistance application unit is configured to apply no resistance to the pivot of the door which is at any position in a first area, and to apply resistance to the pivot of the door which is at any position in a second area, wherein the first area is between the closure position and a first position where the door pivots from the closure position by a first angle, and the second area is an area where the door pivots to be opened over the first position, wherein, in a state in which the door is at the closure position, a centroid of the door is located on a first side of a vertical line passing through a center of the pivot, wherein, when the centroid of the door is located on the vertical line passing through the center of the pivot, the door is in the first area, wherein, in a state in which the door is at the first position, the one end of the sheet stacking surface is located higher than the other end of the sheet stacking surface and the centroid of the door is located on a second side of the vertical line passing through the center of the pivot and a self-weight of the door acts on the door in a direction moving from the first position to the second area, wherein, in a state in which the door is at a second position in the second area, the sheet stacking surface is horizontal, and wherein, in a state in which the door is at a third position in the second area, the one end of the sheet stacking surface is located lower than the other end of the sheet stacking surface.

15. A sheet stacking apparatus comprising:

a door pivotable about a pivot relative to an apparatus main body;

a sheet stacking unit provided in the door, wherein the sheet stacking unit includes a sheet stacking surface onto which sheets are to be stacked, and wherein one end of the sheet stacking surface is located higher than the other end of the sheet stacking surface in a state in which the door is at a closure position, and the one end of the sheet stacking surface can be located lower than the other end of the sheet stacking surface in a state in which the door is opened from the closure position; and a resistance application unit configured to apply resistance against the pivot of the door being moved to be opened, wherein the resistance application unit is configured to apply no resistance to the pivot of the door which is at any position in a first area, and to apply resistance to the pivot of the door which is at any position in a second area, wherein the first area is between the closure position and a first position where the door pivots from the closure position by a first angle, and the second area is an area where the door pivots to be opened over the first position, wherein, in a state in which the door is at the closure position, a centroid of the door is located on a first side of a vertical line passing through a center of the pivot, wherein, when the centroid of the door is located on the vertical line passing through the center of the pivot, the door is in the first area, wherein, in a state in which the door is at the first position, the centroid of the door is located on a second side of the vertical line passing through the center of the pivot and a self-weight of the door acts on the door in a direction moving from the first position to the second area, wherein, in a state in which the door is at the first position where the door pivots from the closure position by the first angle, the sheet on the sheet stacking surface does not move, along the sheet stacking surface, to the one end side of the sheet stacking surface by weight of the sheet, and wherein, in a state in which the door is at a second position in the second area, the sheet on the sheet stacking surface can move, along the sheet stacking surface, to the one end side of the sheet stacking surface by weight of the sheet.

16. The sheet stacking apparatus according to claim 15, wherein the resistance application unit includes a damper gear provided at one of the door and the apparatus main body, and a rack gear provided at the other of the door and the apparatus main body, and wherein the damper gear and the rack gear engage with each other when the door is in the second area, and the damper gear and the rack gear do not engage each other when the door is in the first area.

17. The sheet stacking apparatus according to claim 15, further comprising a regulating unit configured to regulate the pivot of the door, wherein, the second area is between the first position and a position where the pivot of the door is regulated by the regulating unit.

18. The sheet stacking apparatus according to claim 15, further comprising a stopper portion configured to abut against an end of the sheets on the one end side on the sheet stacking surface to prevent the sheets on the sheet stacking unit from falling at a time at which the door is opened.

* * * * *